United States Patent [19]

Hirsch et al.

[11] 4,101,713

[45] Jul. 18, 1978

[54] FLAME SPRAY OXIDATION AND CORROSION RESISTANT SUPERALLOYS

[75] Inventors: Harold H. Hirsch; John R. Rairden, III, both of Schenectady, N.Y.

[73] Assignee: General Electric Company, Schenectady, N.Y.

[21] Appl. No.: 759,440

[22] Filed: Jan. 14, 1977

[51] Int. Cl.[2] ..... B32B 15/20

[52] U.S. Cl. ..... 428/554; 427/405; 427/423; 428/553; 428/564; 428/652; 428/656; 428/667; 428/668; 428/678; 428/937

[58] Field of Search ..... 428/553, 884, 564, 937, 428/652, 666, 667, 657, 678, 656; 427/423, 34, 405

[56] References Cited

U.S. PATENT DOCUMENTS

| | | | |
|---|---|---|---|
| 3,723,092 | 3/1973 | Benjamin | 75/0.5 R |
| 3,754,903 | 8/1973 | Goward et al. | 428/667 |
| 3,864,093 | 2/1975 | Wolfa | 428/864 |
| 3,873,347 | 3/1975 | Walker et al. | 427/405 |
| 3,926,568 | 12/1975 | Benjamin et al. | 75/0.5 BC |
| 3,961,098 | 6/1976 | Bessen | 427/423 |
| 3,993,454 | 11/1976 | Giggins, Jr. et al. | 428/553 |
| 4,005,989 | 2/1977 | Preston | 428/666 |

FOREIGN PATENT DOCUMENTS

| | | | |
|---|---|---|---|
| 49-46,523 | 12/1970 | Japan | 427/423 |

*Primary Examiner*—Arthur J. Steiner
*Attorney, Agent, or Firm*—F. W. Turner; J. T. Cohen; M. Snyder

[57] ABSTRACT

A flame sprayed high energy milled powder coated article comprising a superalloy substrate and a coating consisting of chromium and at least one element selected from iron, cobalt or nickel. Optionally the coating can contain other elements, e.g., aluminum, carbon, yttrium or the rare earth elements.

24 Claims, 5 Drawing Figures

Attrited Co-32Cr-3Al Flame Spray Powder Morphology

*Fig. I*
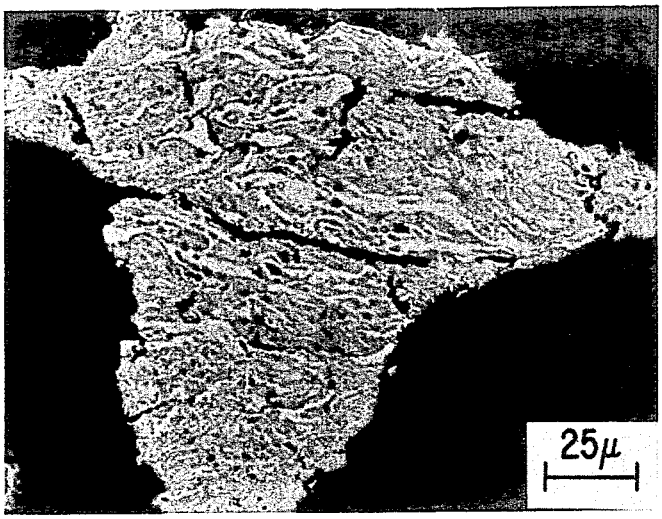
Attrited Co-32Cr-3Al Flame Spray Powder Morphology

Fig. IIa
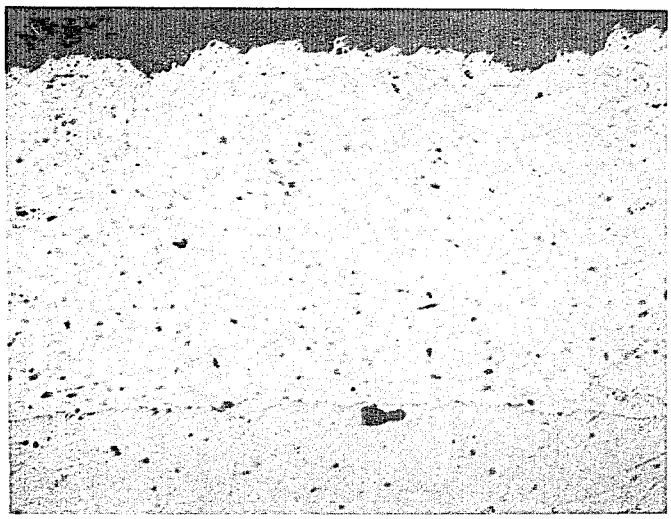
Attrited Co-32Cr-3Al Flame Sprayed On IN-738 At ∿2000 ft./sec. In Argon As Deposited Prior To H.C.B.R. Test
Fig. IIb
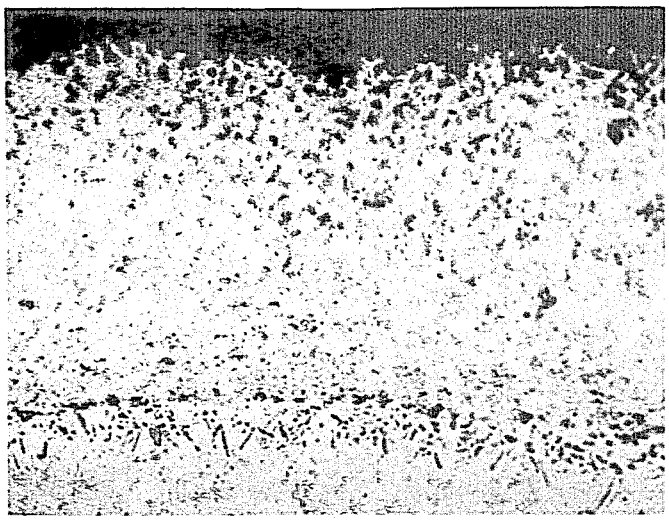
Attrited Co-32Cr-3Al Flame Sprayed On IN-738 At ∿2000 ft./sec. In Argon After H.C.B.R. Test Fig. IIIa
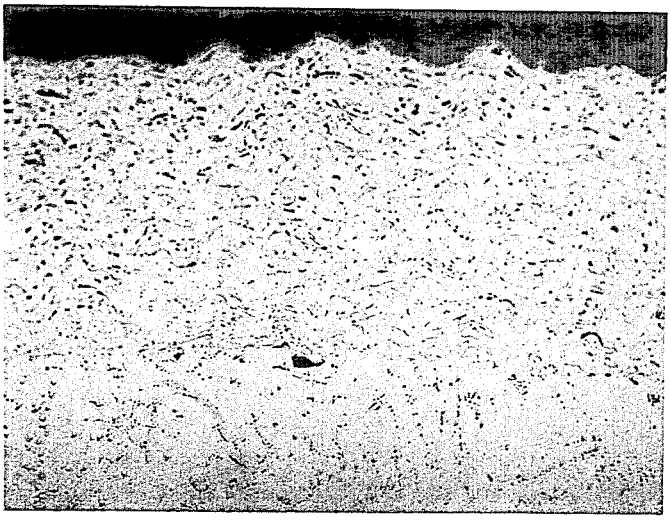
Attrited Co-29Cr-6Al-1Y Flame Sprayed On IN-738 At ~500 ft./sec. In Argon As Deposited Prior To H.C.B.R. Test
Fig. IIIb
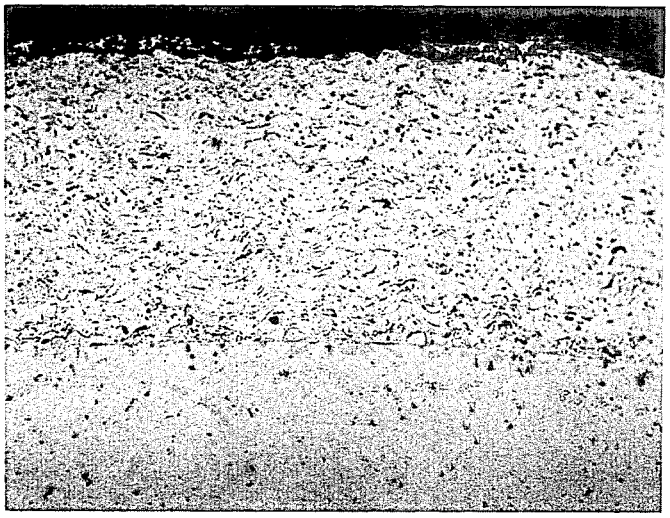
Attrited Co-29Cr-6Al-1Y Flame Sprayed On IN-738 At ~500 ft./sec. In Argon After H.C.B.R. Test

FLAME SPRAY OXIDATION AND CORROSION RESISTANT SUPERALLOYS

BACKGROUND OF THE INVENTION

This invention relates to a flame sprayed high energy milled powder coated article of manufacture having improved high temperature oxidation and corrosion resistance comprising: (a) a superalloy substrate, and (b) a coating consisting of chromium and at least one element selected from iron, cobalt or nickel. Optionally the coatings can contain other elements, e.g., aluminum, carbon, yttrium or the rare earth elements, etc. Another embodiment comprises an aluminized overcoating of the flame sprayed coated superalloy. Another embodiment comprises the method of making the article of manufacture described herein.

DESCRIPTION OF THE PRIOR ART

Flame spraying of metal powders are described by Dietrich et al. in U.S. Pat. No. 3,322,515, issued May 30, 1967. In brief, Dietrich et al. describes flame spraying clad powders comprising two components which will exothermically react peferably consisting of a nucleus of one of the components and at least one coating layer of the other component. Bessen in U.S. Pat. No. 3,957,454, issued May 18, 1976 describes plasma spraying superalloy articles coated with an MCr-base type of coating wherein M represents iron, cobalt or nickel or its modifications in combination with aluminum or its alloys for enhanced hot corrosion and ductility. Bessen discloses plasma spraying of MCr-base alloy powders in an inert atmosphere of argon and hydrogen gas to reduce oxidation of the heated particles during deposition. Bessen also discloses retention of work in the particle, avoidance of melting of the particles in order to propel toward and impinge upon the substrate a heated rather than molten particle in order to enhance retention of deformation in the deposited particle upon cooling through conduction of heat into substrate.

Although the above-described prior art describes plasma flame spraying of certain metal powder forms, heretofore to the best of our knowledge the prior art has not prepared nor recognized the advantages and/or properties associated with flame sprayed high energy milled powder coated superalloy articles of manufacture.

DESCRIPTION OF THE INVENTION

This invention embodies an article of manufacture comprising a flame sprayed high energy milled powder coated superalloy substrate. Another embodiment comprises an aluminized overcoating of the flame sprayed coated superalloy. Another embodiment comprises the method of making the article of manufacture.

Another preferred embodiment of the invention relates to a flame sprayed high energy milled coated article of manufacture having improved high temperature oxidation and corrosion resistance comprising: (a) superalloy substrate, and (b) a coating consisting of chromium and at least one element selected from iron, cobalt or nickel. Optionally, the coating can contain other elements, e.g., aluminum carbon, yttrium, or, the other rare earth elements, etc.

Any superalloy substrate can be employed including, for example, those described within the Compilation of Chemical Compositions and Rupture Strengths of Superalloys described in ASTM data series publication No. 9S9E. Especially useful are superalloys which include carbon within the alloy and rely on carbides for at least a portion of their reinforcing strengths, e.g., (1) carbide reinforcement of grain boundaries in (a) monocarbide form, commonly referred to as MC, and (b) chromium carbide forms, commonly referred to as $M_{23}C_6$ and $M_7C_3$, (2) refractory metal carbides, etc., in platelet or fiber form strengthening grain interiors, aligned or nonaligned in accordance with the method of casting using conventional or directional solidification casting techniques. Representative of generally useful superalloys include nickel-base alloys e.g., IN-738, MAR-M200, NX-188, Rene 80, Rene 95, TAZ-8B, TRW VI A and WAZ-20, etc.; iron-nickel-base alloys, e.g., Incoloy 802, S-590, Duraloy "HOM-3," etc.; cobalt-base alloys, e.g., FSX-414, FSX-430, MAR-M509, X-45, etc., or refractory metal alloys, e.g., WC3015, Cb132M, SU31 and TZC, etc.

Any high energy milled powder coating composition can be employed. Illustratively heat, oxidation, corrosion, etc., resistant and/or dispersion strengthened coatings, e.g., coating compositions based on nickel-chromium, cobalt-chromium and iron-chromium systems which optionally can contain and in addition other alloying metals, e.g., molybdenum, tungsten, columbium and/or tantalum, aluminum, titanium, zirconium, etc., or nonmetals, e.g., carbon, silicon, boron, etc. can be used. A presently preferred coating composition comprises oxidation and corrosion resistant nickel-chromium or cobalt-chromium alloys containing in addition, optionally one or more of the following elements, aluminum, carbon, yttrium or any of the other rare earth elements. The coating compositions can be generically described by the formulas:

MCr, MCrAl, MCrAlY or MCrAlCY, in which M is the base metal element, e.g., iron, cobalt or nickel; Cr represents chromium; Al represents aluminum; C represents carbon; Y represents yttrium and the other rare earth elements.

Another inventive embodiment includes coating compositions which contain a hard phase or dispersoid, e.g., an aluminum, thorium or yttrium oxides, etc., which effectively dispersion-strengthen the coating composition after being flame sprayed on a superalloy substrate.

Presently preferred coating compositions include composition, on a weight percentage basis, set out in the following table:

TABLE A

| Ingredients | Coating Compositions | | | | | | | | | |
|---|---|---|---|---|---|---|---|---|---|---|
| | 1 | 2 | 3 | 4 | 5 | 6* | 7* | 8* | 9 | 10 |
| 1. chromium | 10–50 | 10—30 | 15–25 | 19–21 | 10–30 | 10—50 | 10–30 | 10–30 | 20–50 | — |
| 2. aluminum | 1–20 | 2–15 | 4–11 | 4–11 | 0–20 | 0–20 | 0–20 | 0–20 | — | 5–20 |
| 3. tantalum | — | — | — | — | 1–10 | — | — | — | — | — |
| 4. platinum | 0–10 | — | — | — | — | — | — | — | — | — |
| 5. hafnium | 0–10 | — | — | — | — | — | — | — | — | — |
| 6. yttrium | 0.–1.5 | 0–1.5 | 0–1.5 | 0–1.5 | 0–1.5 | — | — | — | — | — |
| 7. carbon | 0.–0.5 | 0–0.2 | 0–0.15 | 0–0.15 | — | — | — | — | — | — |

TABLE A-continued

| Ingredients | Coating Compositions 1 | 2 | 3 | 4 | 5 | 6* | 7* | 8* | 9 | 10 |
|---|---|---|---|---|---|---|---|---|---|---|
| 8. thorium oxide | — | — | — | — | — | — | — | 0.1–5.0 | — | — |
| 9. aluminum oxide | — | — | — | — | — | — | 0.1–5.0 | — | — | — |
| 10. yttrium oxide | — | — | — | — | — | 0.1–5.0 | — | — | — | — |
| 11. iron/cobalt or nickel | Bal. | Bal. | Bal. | Bal. | Bal. | Bal. | Bal. | Bal. | Bal. | Bal. |

*Dispersion strengthened, oxidation resistant alloys.

Essential to the utilization of the coating compositions of our invention is high energy milling of the elements employed in our coating compositions. Any method and any apparatus known to those skilled in the art can be used which will prepare a mechanically alloyed metal powder comprising a plurality of constituents, at least one of which is a metal having the characteristic of being compressively deformable. Of particular use are attritor mills or vibratory mills.

"Mechanical alloying" is that state which prevails in a composite metal particle produced by high energy milling wherein a plurality of constituents or alloy elements in the form of powders, at least one of which is a compressively deformable metal are caused to be bonded or united together by the application of mechanical energy in the form of a plurality of repeatedly applied compressive forces sufficient to vigorously work and deform at least one deformable metal and cause it to bond or weld to itself and/or to the remaining constituents, be they metals and/or nonmetals whereby the constituents are intimately united together and identifiably codisseminated throughout the internal structure of the resulting composite metal particles.

In a preferred embodiment, mechanical alloying includes mechanical alloying by repeated application of compressive forces in the presence of attritive elements maintained kinetically in a highly activated state of relative motion, and continuing for a time sufficient to cause the constituents to comminute and bond or weld together and codisseminate throughout the resulting metal matrix of the powder product.

Preferably, high energy includes milling at the energy state developed when sufficient mechanical energy is supplied to a coating composition under conditions wherein a substantial portion of the mass of the attritive elements are maintained kinetically in a highly activated state of relative motion. Any high energy mill can be employed including those described in U.S. Pat. Nos. 3,591,362, 2,764,359 and Perry's Chemical Engineers' Handbook, fourth Edition at Section 8, pages 26, etc., Library of Congress No. 6113168.

The uniqueness of the products of our invention is related to the fact that:

(a) high energy milled powder — although not completely alloyed on a submicroscopic scale and which essentially contains all of the alloy constituents of a coating — is flame sprayed on a superalloy substrate, (b) flame spraying of the powder releases exothermic heat of reaction as intermetallic alloys form during flame spraying, (c) flame spraying of the powder releases via exothermic heat at least a portion of the work mechanically introduced by compressive forces during attriting of the powders, and (d) flame spraying of the powder substantially homogeneously disperses a hard phase or dispersoid in the coatings, when the coating powder contains elements that form dispersions under high energy milling conditions.

Any particle powder coating size range can be employed and varies in accordance with the type and design of the flame spray apparatus employed. Correlation of flame spray apparatus and powder coating particle size distribution can be readily determined by those skilled in the art through routine experimentation. In a preferred embodiment where oxidation and/or corrosion resistant coatings are applied to superalloy substrates such as those defined hereinbefore by the general formulas in MCr, MCrAl, MCrAlY, or MCrAlCY, flame sprayed oxidation and corrosion resistant superalloy articles of manufacture having optimum properties are obtained wherein the powder coating particles have a maximum particle size of less than 44 microns and preferably are within an average particle size range of less than 30 microns and further are within an average particle size of from about 20–30 microns. Wherein dispersoid submicron dispersion strengthening particles are contained by the coating, preferably the coating powders contain from about 0.5 to about 5 percent by volume of dispersoid particles, e.g., $Al_2O_3$, $ThO_2$, $Y_2O_3$, etc., having an average particle size (aps) of about 300 Angstroms (0.03 microns) and an "aps" range of from 50Å to 1000Å uniformly dispersed therein. Dispersoid strengthened high energy milled powders coated superalloys are preferred articles of manufacture since it is believed, especially when MCrAlY coatings are employed, that the incorporation of a dispersoid coating phase such as yttrium oxide significantly contributes to the maintenance of the mechanical integrity of the coating throughout the thickness of the coating, especially at elevated temperatures commonly associated with high temperature performance of gas turbine jet engines, e.g., temperatures within the range of from about 800° C. to 1200°–1300° C., or even higher. Further, it is believed that the incorporation of dispersoid within the oxidation and corrosion resistant coating assists in raising the resistance to transmission of stress throughout the matrix of the coating and thereby adds to the service life or strength of the coating composition at elevated temperatures. It is believed that the use of high energy milled powders wherein dispersion strengthening oxides are uniformly dispersed in submicron form within the powder to be flame sprayed on superalloy substrates comprises a novel concept since atomizing alloys containing the same elements employing powder atomizing techniques commonly employed commercially heretofore will not result in the formation of dispersoid particles in submicron form uniformly dispersed within the coating powders nor, accordingly, uniformly dispersed throughout flame sprayed coating of superalloy substrate.

The application of high energy milling to the preparation of flame spray coating compositions furnishes a method heretofore unrecognized by the prior art, i.e., a method which is an economical, effective means of preparing coated superalloys having coating compositions consisting of essentially an unlimited number of alloy combinations and alloying ingredients combinable in any particle size, distribution and composition which can be designed to fit any coating requirement employing flame spraying techniques.

In general, illustrative methods and apparatus that can be employed in flame spraying are any of those described in the Flame Spray Handbook, Vol. II and Vol. III, by H. S. Ingham and A. P. Shepard, published by Metco, Inc., Westbury, Long Island, N.Y. (1965); "Applied Mineralogy" Technische Mineralogie "Arc Plasma Technology in Materials Science," by D. A. Gerdeman and N. L. Hecht, Springkr-Verlag, Eighth International Thermal Spraying Conference, Miami Beach, Fla., Sept. 27 to Oct. 1, 1976, including those described in U.S. Pat. Nos. 3,436,248 and 3,010,009, etc. Our invention can be carried out at any flame spraying temperature. Typically, a thermal spray gun is operated using an oxy-acetylene flame at temperatures of up to 5000° F. and a plasma spray gun operating at temperatures of 12,000° to 20,000° F. The plasma spray process is particularly useful for depositing dense coatings because particle velocities of 500 to 3000 ft./sec. can be achieved; preferably, particle speeds of about 2000 to 3000 ft./sec. are employed. Preparation of the substrate surface, if desired, can be carried out by any means known to those skilled in the art. Our process can be carried out under any atmospheric conditions, e.g., oxidizing, inert or reducing conditions, atmospheric, subatmospheric or superatmospheric pressures, etc. In a preferred embodiment, our process is carried out under vacuum conditions approaching approximately one tenth of an atmosphere or less.

After flame spray coating of the superalloy substrates, the coated substrates can be overaluminized by any method known to those skilled in the art including diffusion coating steps commonly referred to in the art as aluminiding, whereby aluminum diffuses into the coating itself and if desired the substrate material. Simultaneously, some elements of the substrate material generally diffuse into the coating. The aluminiding can be carried out by any methods known to those skilled in the art including methods commonly referred to as pack cementation, physical vapor deposition, chemical vapor deposition, etc.

Our invention is more clearly understood from the following description taken in conjunction with the accompanying figures described hereinafter:

FIG. I is a photomicrograph (600×) of an attrited cobalt-32 chromium-3 aluminum powder particle. The figure illustrates the cold worked attrited powder characteristics of a mechanically alloyed coating composition prior to flame spraying onto an IN738 superalloy substrate having the following composition: 0.17 C; 0.20 Mn; 0.30 Si; 16.0 Cr; 8.5 Co; 1.75 Mo; 2.6 W; 0.9 Cb; 3.4 Ti; 3.4 Al; 0.01 B; 0.10 Zr; 0.50 Fe; 1.75 Ta; balance Ni.

FIG. II*a* is a photomicrograph (250×) of a Co-32Cr-3Al coating flamed sprayed (using the attrited powder of FIG. I in a particle size range of 5 to 44 microns on an IN738 superalloy substrate in an inert argon atmosphere at a powder particle transmission speed of about 2000 ft./sec. which illustrates the characteristics of the coating after flame spraying prior to hot corrosion testing.

FIG. II*b* is a photomicrograph (250×) of the coatings of FIG. II*a* after being subjected to a Hot Corrosion Burner Rig (H.C.B.R.) test for 1651 hours at 1700° F. which simulates highly corrosive conditions experienced in marine gas turbine engine tests.

FIG. III*a* is a photomicrograph (250×) of an attrited cobalt 29-chrome 6-aluminum 1-yttrium coating flame sprayed on an IN738 superalloy substrate in an inert argon atmosphere at a powder particle transmission speed of about 500 ft./sec. which illustrates the characteristics of the coating after flame spraying prior to hot corrosion testing.

FIG. III*b* is a photomicrograph (250×) of coatings of FIG. III*a* after being subjected to a H.C.B.R. test for 1000 hours at 1700° F.

Our invention is further illustrated by the following examples:

EXAMPLE I

Alloy powders containing, on a weight basis, 65% Co-32% Cr-3% Al of the morphology of FIG. I were prepared from the following starting powder materials:

CoAl: 77.2 gm. −200 mesh
Cr: 264.4 gm. −200 mesh
Co: 484.7 gm. −1.4μ average

The above powders (unoxidized beyond that naturally occurring on the surface of the powder) were combined and attrited using a Type R, Size 1S, Intermittent Type Attritor manufactured by Union Process Inc., Akron, Ohio, operated at ~150 rpm for 20 hours using an argon atmosphere. The nickel attritor balls (N.A.B.) were heavily coated with powder after milling. The attrited powder was stripped from the N.A.B. by an additional two hours of attritor milling using a raised perforated bottom plate.

The resulting attrited powder was screened to yield a high fraction (64.2%) of −325 mesh (less than 44 microns) powder. The +325 mesh powder was reduced to −325 mesh by simple (non-attritor) ballmilling. Attrited powder having a particle size of less than 44 microns was used to coat superalloy (Rene 80 and IN-738) pin specimens using two different flame spraying apparatus:

1. A Metco Type 3MB gun; a high-intensity, non-transferred constricted arc device operated in an air atmosphere.
2. A Plasmadyne 80-KW Model SG-1083A gun; a vortex stabilized arc device operated in an argon atmosphere.

Flame spray coatings formed under both conditions were highly dense, as measured by metallographic examination. The air atmosphere deposited coatings contained a large fraction of oxides. The argon atmosphere deposited coatings were nearly oxide-free.

Table I entitled "Burner Rig Test Data" summarizes control and test conditions associated with the flame sprayed (FIG. II*a*) and the hot corrosion tested (FIG. II*b*) Co-32 Cr-3 Al coatings relative to Rene 80 and the IN-738 superalloy substrates.

TABLE I

| Run No. | Coating Composition | Substrate | Spray Velocity (ft./sec.) | Burner Rig Test Data: Spray Atmos. | Coating Thickness | Burner Temp. | Hours On Test | Hot Corrosion Effects* |
|---|---|---|---|---|---|---|---|---|
| 1. | Co-32Cr-3Al Attrited | Rene 80 | 500 Arc Plasma | Air | 7.5 mil | 1700° F | 1651 | 5 mil coating remaining. Evidence of slight substrate penetration. |
| 2. | Co-32Cr-3Al Attrited | IN-738 | 1000 Arc Plasma | Argon | 9 mil | 1700° F | 1651 | 8 mil coating remaining. Evidence of intergranular attack. |
| 3. | Co-32Cr-3Al | IN-738 | 2000 Arc Plasma | Argon | 8 mil | 1700° F | 1651 | 8 mil coating remaining. Much less intergranular attack than Run No. 2 |
| 4. | Control Uncoated | IN-738 | — | — | — | 1700° F | 2507 | Nearly completely corroded 170 mil dia. pin. |
| 5. | Control Uncoated | IN-738 | — | — | — | 1700° F | 153 | 3-5 mils penetration. |

*Hot Corrosion Effects were determined by exposure of the flame sprayed coating to a diesel fuel containing 1% by weight sulfur and 467 parts per million of sea salt at the burner temperatures designated above with thermal cycling of test specimens to room temperature 3-5 times per week.

EXAMPLE II

Alloy powders containing, on a weight basis, 64% Co-29% Cr 6% Al-1% Y were prepared from the following starting powder materials:

CoAl: 399.7 gm. −200 mesh
Cr: 243.6 gm. −200 mesh
Co: 160.5 gm. −200 mesh
CrY: 36.2 gm. −200 mesh The powders were combined and attrited as in Example I. The resulting attrited powder was screened to yield 53% of −400 mesh (less than 37 microns) powder. Any +400 mesh powder was reduced to −400 mesh by simple non-attritor ball milling prior to flame spraying. The attrited powder was flame sprayed onto an IN-738 superalloy pin specimen using a Metco 3MP; gun a high-intensity nontransferred constricted art device operated in an argon/hydrogen gas atmosphere.

Table II entitled "Burner Rig Test Data" summarizes control and test conditions associated with the flame sprayed (FIG. III*a*) and the hot corrosion tested (FIG. III*b*) Co-29 Cr-6 Al-1 Y coatings relative to the IN-738 superalloy substrates.

TABLE II

| Run No. | Coating Composition | Substrate | Spray Velocity (ft./sec.) | Burner Rig Test Data: Spray Atmos. | Coating Thickness | Burner Temp. | Hours On Test | Hot Corrosion Effects* |
|---|---|---|---|---|---|---|---|---|
| 1. | Co-29Cr-6Al-1Y | IN-738 | 500 | Argon/Th | 7-8 mil | 1700° F | 1000 | Essentially unaffected - coating surface corroded less than 1/10 mil. |
| 2. | Control Uncoated | IN-738 | — | — | — | 1700° F | 2507 | Nearly completely corroded 170 mil dia. pin. |
| 3. | Control Uncoated | IN-738 | — | — | — | 1700° F | 153 | 3-5 mils penetration. |

*Hot Corrosion Effects were determined as in Example I by exposure of the flame sprayed coating to a diesel fuel containing 1% by weight sulfur and 467 parts per million of sea salt at the burner temperatures designated above with thermal cycling of test specimens to room temperatures 3-5 times per week.

other alloy powders containing, on a weight percent basis, the compositions which follow:

Co-32Cr-3Al
Co-29Cr-6Al
Co-29Cr-6Al-0.1C
Co-39Cr-6Al-0.1C
Ni-20Cr-5Al-0.1Y-0.1C
Ni-20Cr-10Al-0.1Y-0.1C
Ni-35Cr-1Al have been prepared in accordance with the attriting process of Examples I and II. These powders have the general morphology of the attrited alloy illustrated by FIG. I and analogous with the alloy compositions of Examples I and II can be employed to provide oxidation and corrosion resistant flame sprayed superalloy compositions.

Although the above examples have illustrated various modifications and changes that can be made in carrying out our process, it will be apparent to those skilled in the art that other changes and modifications can be made in the particular embodiments of the invention described which are within the full intended scope of the invention as defined by the appended claims.

We claim:

1. An article comprising a coated superalloy body, said body having been flame spray coated with high energy milled, mechanically alloyed powder particles having an average particle size of less than about 44 microns.

2. The claim 1 article, wherein said body is selected from a nickel- or a cobalt-base superalloy.

3. The claim 1 article, wherein the powder contains dispersoid particles.

4. The claim 1 article, wherein the powder contains heat-fusible alloy components.

5. The claim 1 article, wherein the powder consists essentially of chromium and at least one element selected from iron, cobalt or nickel.

6. The claim 5 article, wherein the powder contains aluminum.

7. The claim 6 article, wherein the powder contains a dispersion strengthening submicron dispersoid.

8. The claim 7 article, wherein said dispersoid is present on a volume basis in an amount of from about 0.5 to 5 percent.

9. The claim 1 article, wherein at least a powder component has a melting point exceeding at least 800° F.

10. The claim 7 article, wherein said dispersoid is selected from $Al_2O_3$, $ThO_2$ or $Y_2O_3$.

11. The claim 1 article, further comprising an aluminized overcoated superalloy body.

12. The claim 1 article, where on a weight percent basis the powder contains 32% Cr, 3% Al and the balance Co and the superalloy body contains 16% Cr, 8.5% Co, 3.4% Ti, 3.4% Al, 2.6% W, 1.75% Mo, 0.3% Si, 0.2% Mn, 0.9% Cb, 0.5% Fe, 0.175% Ta, 0.17% C, 0.01% B, 0.10% Zr, and the balance Ni.

13. The claim 1 article, where on a weight percent basis the powder contains 29% Cr, 6% Al, 1% Y and the balance Cr and the superalloy substrate contains 16% Cr, 8.5% Co, 3.4% Ti, 3.4% Al, 2.6% W, 1.75% Mo, 0.3% Si, 0.2% Mn, 0.9% Cb, 0.5% Fe, 0.175% Ta, 0.17% C, 0.01%B , 0.10% Zr, and the balance Ni.

14. The method of improving the high temperature oxidation and corrosion resistance of a superalloy body which comprises flame spraying the superalloy body with high energy milled, mechanically alloyed powder particles having an average particle size of less than about 44 microns.

15. The method of claim 14, further comprising (b) overaluminizing the resulting flame sprayed superalloy body.

16. The claim 14 method, wherein the superalloy body is selected from nickel or a cobalt-base superalloy.

17. The claim 16 method, wherein the powder consists essentially of chromium and at least one element selected from iron, cobalt or nickel.

18. The claim 17 method, wherein the powder contains aluminum.

19. The claim 18 method, wherein the powder contains a dispersion strengthening submicron dispersoid.

20. The claim 19 method, wherein the dispersoid is present on a volume basis in an amount of from about 0.5 to 5%.

21. The claim 1 article wherein said particles have an average particle size of less than about 30 microns.

22. The claim 1 article wherein said particles have an average particle size of from about 20 to 30 microns.

23. The claim 14 method wherein said particles have an average particle size of less than about 30 microns.

24. The claim 14 method wherein said particles have an average particle size of from about 20 to 30 microns.

* * * * *